US009943177B1

(12) United States Patent
Miloserny et al.

(10) Patent No.: US 9,943,177 B1
(45) Date of Patent: Apr. 17, 2018

(54) DISPLAY AND STORAGE CABINET AND RELATED METHODS

(71) Applicant: CREATIVE DISPLAY WORKS, INC, Queen Creek, AZ (US)

(72) Inventors: Timothy Miloserny, Tempe, AZ (US); Lea Miloserny, Tempe, AZ (US)

(73) Assignee: Creative Display Works, Inc., Phoenix, AZ (US)

( * ) Notice: Subject to any disclaimer, the term of this patent is extended or adjusted under 35 U.S.C. 154(b) by 0 days.

(21) Appl. No.: 15/590,953

(22) Filed: May 9, 2017

(51) Int. Cl.

| | |
|---|---|
| ***A47F 3/06*** | (2006.01) |
| ***A47F 5/00*** | (2006.01) |
| ***A47F 1/12*** | (2006.01) |
| ***A47F 3/02*** | (2006.01) |

(52) U.S. Cl.
CPC ..... *A47F 3/06* (2013.01); *A47F 1/126* (2013.01); *A47F 3/02* (2013.01); *A47F 5/0018* (2013.01); *A47F 5/0087* (2013.01)

(58) Field of Classification Search
CPC .. A47F 3/06; A47F 3/02; A47F 5/0018; A47F 5/0087
See application file for complete search history.

(56) References Cited

U.S. PATENT DOCUMENTS 786,104 A * 3/1905 Currie ..... A47F 3/06 312/120
1,272,989 A * 7/1918 Ostram ..... A47F 3/06 312/120
3,986,759 A * 10/1976 Holstein ..... A47F 3/02 312/265.6
5,205,436 A * 4/1993 Savage ..... A47F 3/02 221/1
2006/0163984 A1* 7/2006 Andersen ..... A47F 3/0486 312/401
2010/0078401 A1* 4/2010 Vulpitta ..... A47F 5/0018 211/153
2016/0007744 A1* 1/2016 Fasino ..... A47F 3/06 312/330.1
2016/0198846 A1* 7/2016 McCuistion ..... A47B 53/02 211/150
2016/0316936 A1* 11/2016 Camello ..... A47F 1/12
2017/0208940 A1* 7/2017 Boudreault ..... A47B 81/00

* cited by examiner

*Primary Examiner* — Daniel J Rohrhoff
(74) *Attorney, Agent, or Firm* — IPTechLaw

(57) ABSTRACT

Implementations of display cabinets may include: a first module having a base, a first shelving area and a second shelving area. The display cabinets may include a first door rotatably positioned adjacent to the first shelving area. Two or more hinges may be front mounted to the first module and front mounted to a side of the first door, where a first one of the hinges may be rotatably coupled into a receiver in the first shelving area and a second one of the hinges may include a pin that couples within a receiver coupled with the base. The display cabinet may have a first display portion coupled to one or more brackets within the base of the first module and a second display portion coupled to one or more brackets positioned on either side of a back panel of the first door.

20 Claims, 11 Drawing Sheets

DISPLAY AND STORAGE CABINET AND RELATED METHODS

BACKGROUND

1. Technical Field

Aspects of this document relate generally to display and storage cabinets, such as displays in stores for products behind the counter. More specific implementations involve compact display storage cabinets for use in convenience stores.

2. Background

Conventionally, to showcase products in a store single depth display shelving is used.

SUMMARY

Implementations of display cabinets may include: a first module having a base, a first shelving area and a second shelving area. The display cabinets may include a first door rotatably positioned adjacent to the first shelving area. Two or more hinges may be front mounted to the first module and front mounted to a side of the first door, where a first one of the hinges may be rotatably coupled into a receiver in the first shelving area and a second one of the hinges may include a pin that couples within a receiver coupled with the base. The display cabinet may have a first display portion coupled to one or more brackets within the base of the first module and a second display portion coupled to one or more brackets positioned on either side of a back panel of the first door.

Implementations of display cabinets may include one, all, or any of the following:

The first door may be reinforced to support a weight of the second display portion.

The first door may be a right-handed door and the two or more hinges may be front mounted on the right side of the right-handed door.

The display cabinet may further include a second door rotatably coupled to a top bar of the first module over the second shelving area.

The first and the second display portions may each include a plurality of slide panels configured to hold and display a product.

The display cabinet may further include: a second module having: a base, a first shelving area, and a second shelving area. The display cabinet may also include a first door rotatably positioned adjacent to the first shelving area and two or more hinges front mounted to the first module and front mounted to a side of the first door. A first one of the hinges may be rotatably coupled into a receiver in the first shelving area and a second one of the hinges may include a pin that couples within a receiver coupled with the base. The display cabinet may also include a first display portion coupled to one or more brackets within the base of the second module and a second module portion coupled to one or more brackets positioned on either side of a back panel of the first door. The first module of the display cabinet may be left-handed and the second module may be right-handed.

The display cabinet may further include two or more additional cabinets each having third display portions, each one of the two or more additional cabinets may be positioned on one of a side of the first module and a side of the second module.

Implementations of display cabinets may include: a first module having a base, a first display portion within the base, a first shelving area above the base, and a second shelving area above the first shelving area. The display cabinet may include a first door coupled to a first side of the first module configured to conceal the first shelving area and two or more hinges front mounted to the first module and front mounted to a side of the first door. A first one of the hinges may be rotatably coupled into a receiver in the first module and a second one of the hinges may include a pin that coupled within a receiver coupled with the base. The display cabinet may also include a second display portion coupled to one or more brackets within the first door. The first door may be rotatable on the two or more hinges across a majority of a width of the first module.

Implementations of display cabinets may include one, all, or any of the following:

The first door may be reinforced to support a weight of the second display portion.

The first door may be a left-handed door and the two or more hinges may be front mounted on the left side of the left-handed door.

The first door may be a right-handed door and the two or more hinges may be front mounted on the right side of the right-handed door.

The display cabinet may further include a second module including: a base, a first shelving area and a second shelving area. The display cabinet may also include a first door rotatably positioned adjacent to the first shelving area and two or more hinges front mounted to the first module and front mounted to a side of the first door. A first one of the hinges may be rotatably coupled into a receiver in the first shelving area and a second one of the hinges may include a pin that coupled within a receiver coupled with the base. The display cabinet may also include a first display portion coupled to one or more brackets within the base of the second module and a second display portion coupled to one or more brackets positioned on either side of a back panel of the first door. The first module may be left-handed and the second module may be right-handed.

The display cabinet may further include two or more additional cabinets each including a third display portion. Each one of the two or more additional cabinets may be positioned on one of a side of the first module and a side of the second module.

Implementations of display cabinets may include: a left module and a right module. Each of the left module and the right module may include: a base, a first display portion within the base, a first shelving area above the base, and a second shelving area above the first shelving area. The left-handed module may further include: a left handed door rotatably coupled to a left side of the left module in a position covering the first shelving area and two or more hinges front mounted to the left module and front mounted to a left side of the left-handed door. A first one of the hinges may be rotatably coupled into a receiver in the left module and a second one of the hinges may include a pin that couples within a receiver coupled with the base of the left module. The right-handed module further includes: a right-handed door rotatably coupled to a right side of the right module in a position covering a width of the first shelving area of the right module and two or more hinges. A first one of the hinges may be rotatably coupled into a receiver in the right module and a second one of the hinges may include a pin that coupled within a receiver coupled with the base of the right module. The left-handed and the right-handed door can each pivot on the two or more hinges and move in and out across a width of the left module and the right module, respectively.

Implementations of display cabinets may include one, all, or any of the following:

The left-handed door and the right-handed door may be each reinforced to support a weight of the second display portion.

The display cabinet may further include a second door rotatably coupled to a top bar of the each of the left module and the right module over the second shelving area.

The first and the second display portions of both the left-handed module and of the right-handed module may each include a plurality of slide panels configured to hold and display a product.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended display cabinet will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such display cabinets, and implementing components and methods, consistent with the intended operation and methods.

Figure 1:
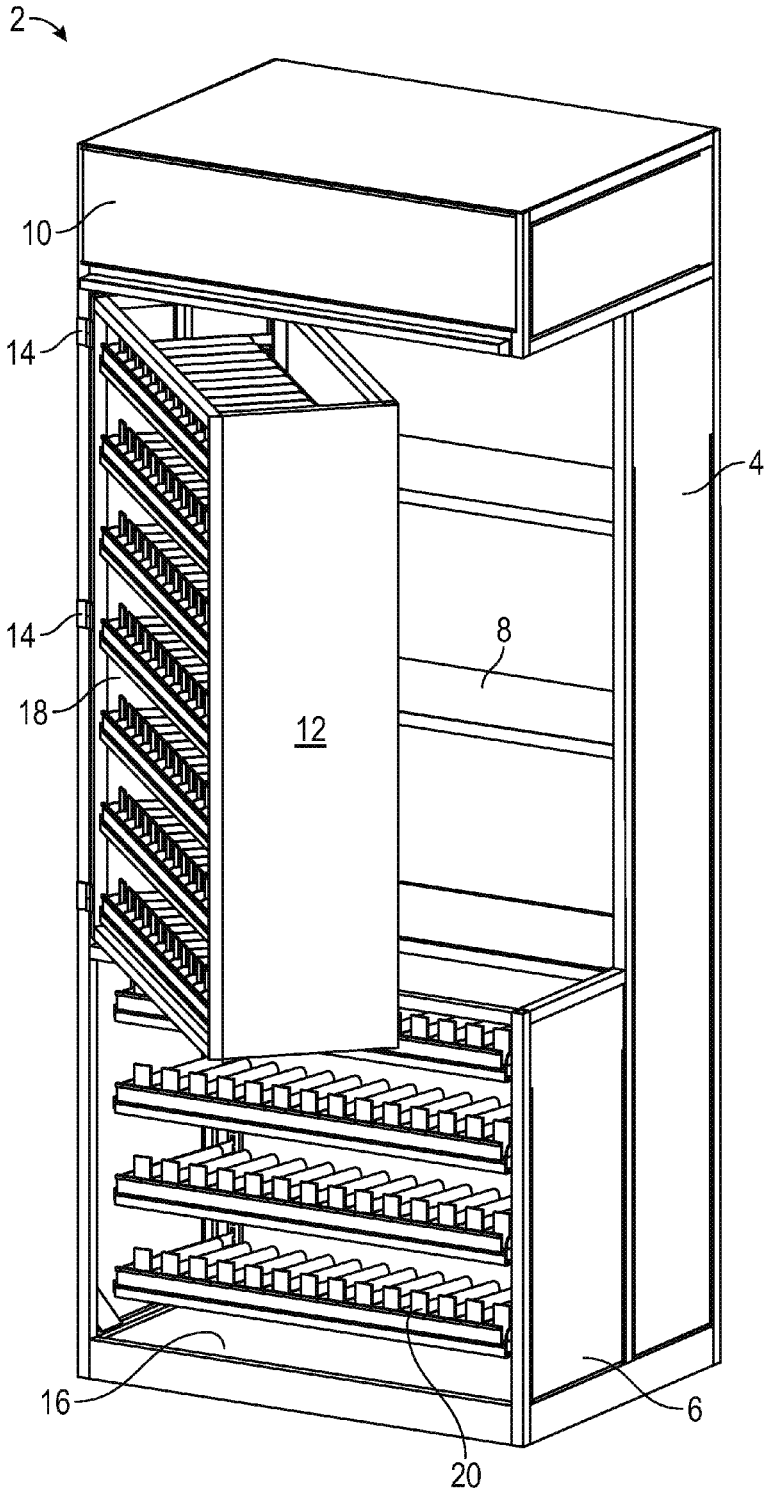
FIG. 1 is a front perspective view of an implementation of a left-handed module of a display cabinet with an open door.

Referring now to FIG. 1, an implementation of a display cabinet 2 is illustrated. The display cabinet includes a first module 4 including a base 6, a first shelving area 8 and a second shelving area 10. The second shelving area 10 is located behind a door that will later be described in greater detail. A first door 12 is rotatably positioned adjacent to the first shelving area 8. In the implementation illustrated, the first door 12 is coupled to the first module 4 through three hinges 14. However, in other implementations, there may be two or more hinges front mounted to the first door and the first module. The hinges used in various implementations may be standard door hinges or they may be custom made hinges as will be described more fully below. The first door 12 is rotatable on the hinges 14 across a majority of a width of the first module 4. The first door may 12 fully conceal the first shelving 8 area when in a closed position or may conceal substantially all of the first shelving area 8 when closed.

In this particular implementation, the first door 12 is a left-handed door and the hinges 14 are front mounted on the left side of the left-handed door. In various implementations, the door may be a right-handed door where the hinges are front mounted on the right-side of the first door. The first module 4 also includes a first display portion 16 and a second display portion 18. The first display portion is coupled to one or more brackets within the base of the first module. The second display portion is coupled to one or more brackets on either side of a back panel of the first door. The first door 12 may be reinforced to support a weight of the second display portion. The first display portion 16 and the second display portion 18 each include a plurality of slide panels 20 configured to hold and display a product. By non-limiting example, the product may include packs of cigarettes, packs of gum, candy bars, and other similarly sized products.

Figure 2:
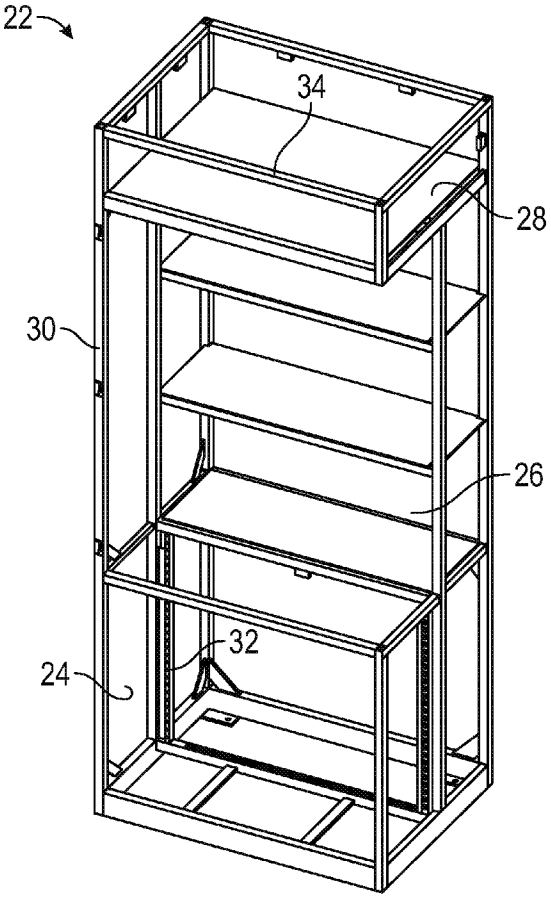
FIG. 2 is a front perspective view of an implementation of a frame of a display cabinet module.

Referring now to FIG. 2, an implementation of a frame of a first module 22 of a display cabinet is illustrated. The frame of the first module 22 includes a base 24, a first shelving area 26, and a second shelving area 28. As previously described, the first door may be rotatably coupled to the side 30 of the first module through two or more front mounted hinges. The first display portion may be coupled to one or more brackets 32 within the base 24 of the first module 22. In various implementations, the brackets may be slotted or double slotted standard shelf brackets. In other implementations, the brackets may be other suitable brackets configured for holding and supporting the slide panels. In various implementations, a second door may be rotatably coupled to a top bar 34 of the first module over the second shelving area 28. By non-limiting example, the frame of the first module 22 may be formed of metal rods including steel, iron, or aluminum; plastic rods including acrylics, polypropylene or nylons; or other suitable materials that can provide sufficient structural support for the other display cabinet components.

Figure 3:
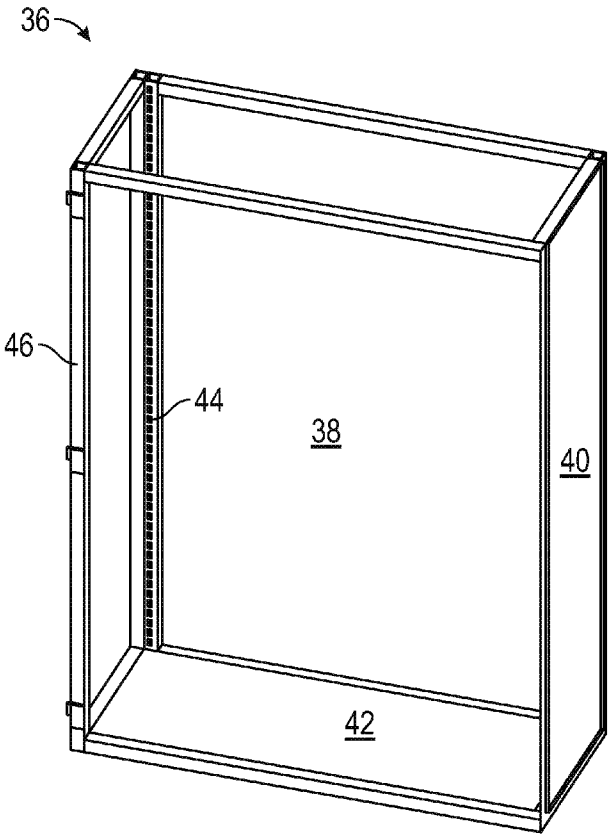
FIG. 3 is a front perspective view of an implementation of a frame of a door of a display cabinet module.

Referring to FIG. 3, an implementation of a frame of a first door 34 of a display cabinet is illustrated. The frame includes a cuboidal shape formed of rods 36. The rods 36 may be formed of metal including steel, iron, or aluminum; plastic including acrylics, polypropylene or nylons; or other suitable materials disclosed herein. In various implementations, the first door 36 may have three panels including a back panel 38, a side panel 40 and a bottom panel 42. On either side of the back panel 38 there are one or more brackets 44. The brackets may be used for the supporting the slide panels which constitute the display panel in the first door 36 as previously described. Two or more hinges may be front mounted to the side 46 of the first door 36 to rotatably couple the first door to the first module.

Figure 4:
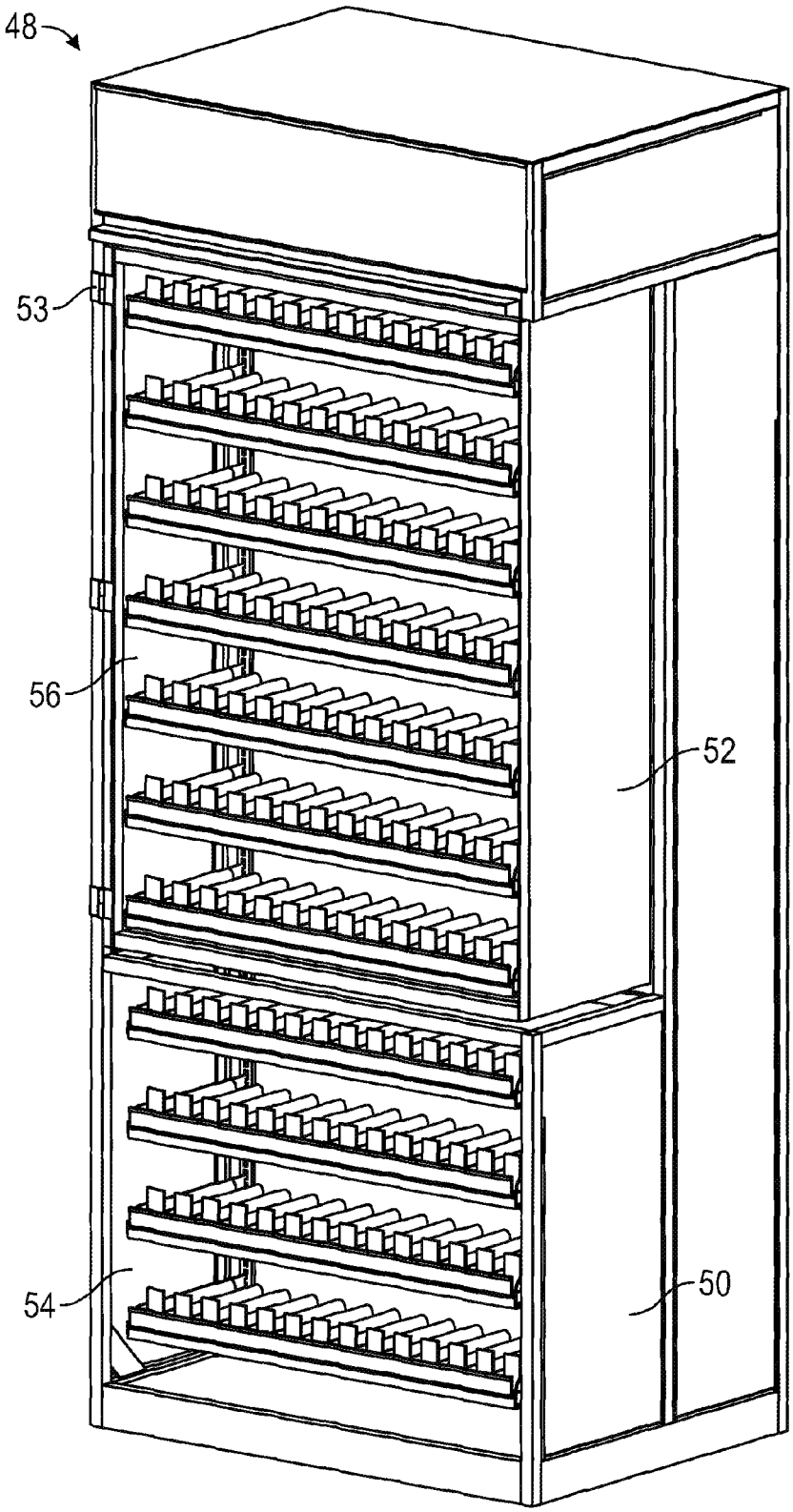
FIG. 4 is a front perspective view of an implementation of a left-handed module of a display cabinet with a closed door.
Figure 5:
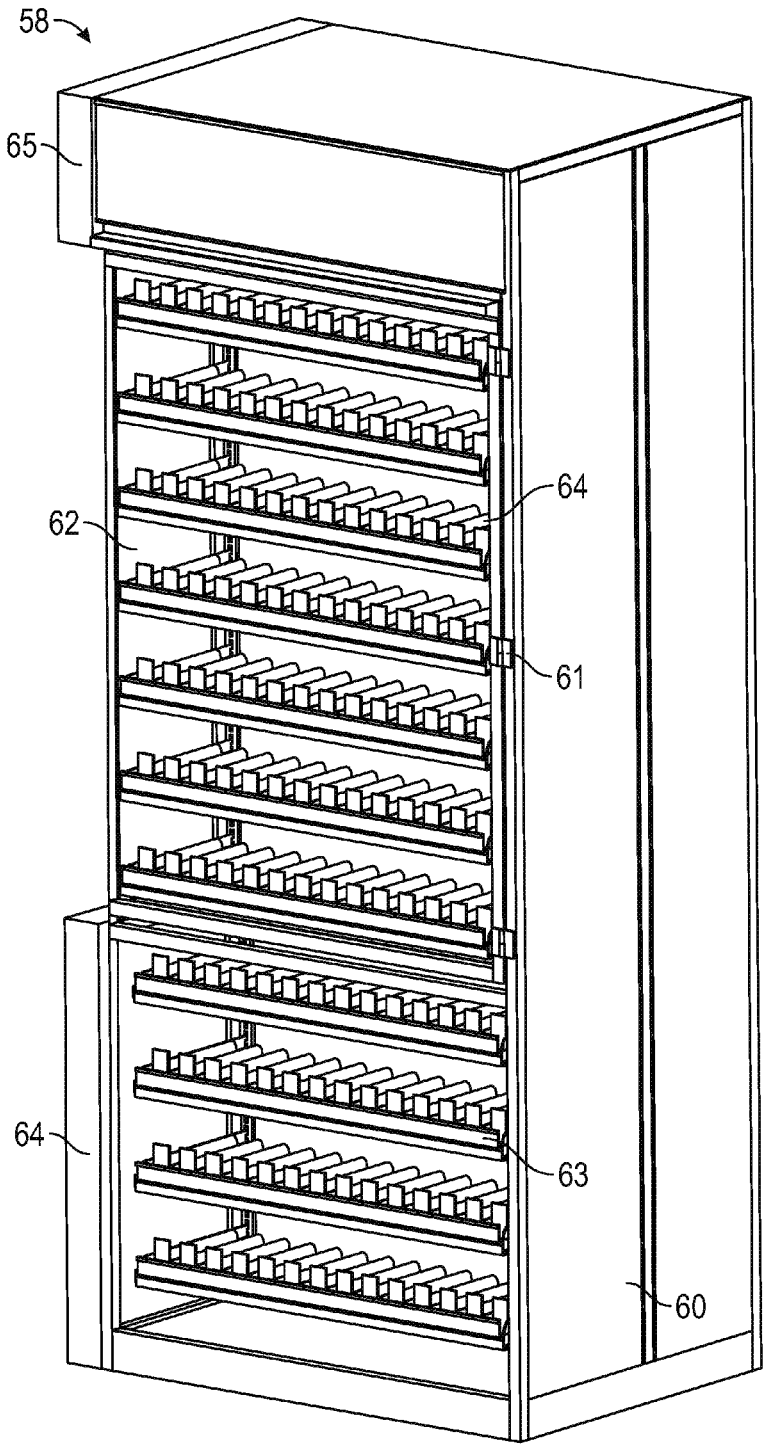
FIG. 5 is a front perspective view of an implementation of a right-handed module of a display cabinet with a closed door.

Referring now to FIGS. 4 and 5, implementations of a left-handed module 48 and a right-handed module 48, respectively, are illustrated. Referring to FIG. 4, as previously described, the left-handed module 48 includes a base 50, a first shelving area and a second shelving area. The first shelving area is concealed by the right-handed door 52 which may be rotatable across a majority of a width of the left-handed module 48. The left handed door 52 is front mounted to the left-handed module 48 by two or more hinges 53 on the left side of the left-handed door 52. The left-handed module 48 includes a first display portion 54 within the base and a second display portion 56 within the left-handed door 52. The left-handed door 52 may be reinforced to support a weight of the second display portion 56.

Referring to FIG. 5, an implementation of a right-handed module 58 is illustrated. The right-handed module 58 also includes a base 60, a first shelving area and a second shelving area. The right-handed door 62 is rotatably coupled to the right side of the right-handed module 58 through two or more hinges 61. The right-handed door may be reinforced to support the weight of the door and the weight of the product in the second display portion 64. The reinforced door may keep the door from sagging, dragging, or pulling on the hinges. The support from the reinforcement may also keep the door and the slide panels in the display portion 64 from bowing. The right-handed module 58 also has a first display portion 63 within the base of the module 60. In various implementations, the right handed module 58 has a connector 65 near the top and the bottom of the module. The connector 65 aids in connecting and stabilizing multiply modules. In other implementations, a right-sided module may include a connector while a left-handed module may not have a connector.

Figure 6:
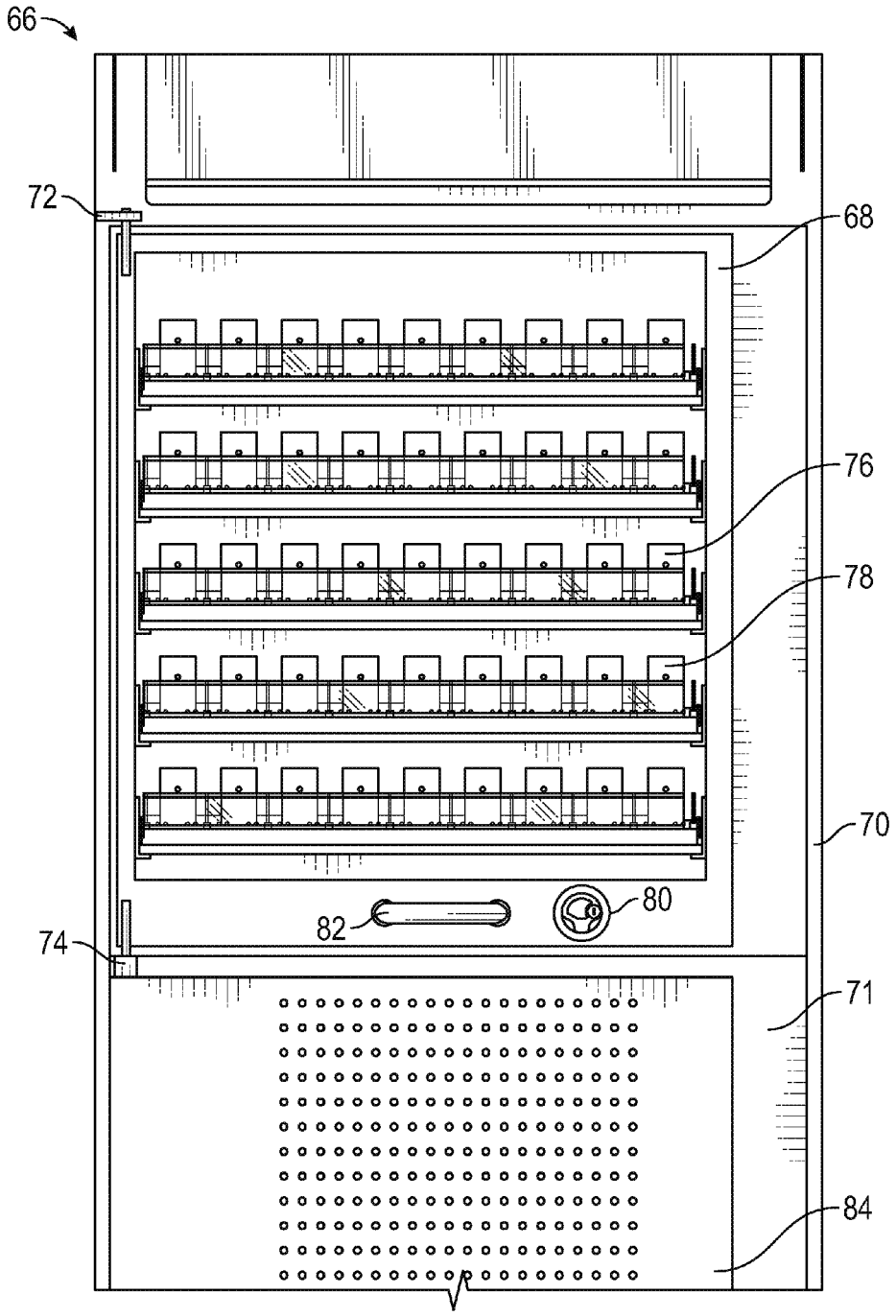
FIG. 6 is a front view of an implementation of a door of a display cabinet.

Referring now to FIG. 6, another implementation of a left-handed module 66 is illustrated. In this implementation, two hinges 72 and 74 are used to front mount the first door 68 to the first module 70. A first one of the hinges 72 is rotatably coupled to into a receiver in the first module and a second one of the hinges 74 includes a pin that couples within a receiver coupled with the base 71. The first door includes a second display portion 76 including a plurality of slide panels 78. Slide panels 78 will be described in further detail below. The first door 68 also includes a lock 80 and a handle 82. The handle 82 may be used to open the first door 68 to access the first storage area behind the door. The handle 82 may likewise be used to close the first door 68 to conceal the first storage area. In various implementations, the base 71 of the first module 70 may not have slide panels in the first display portion. In this particular implementation, the back panel of the base 84 is visible.

Figure 7:
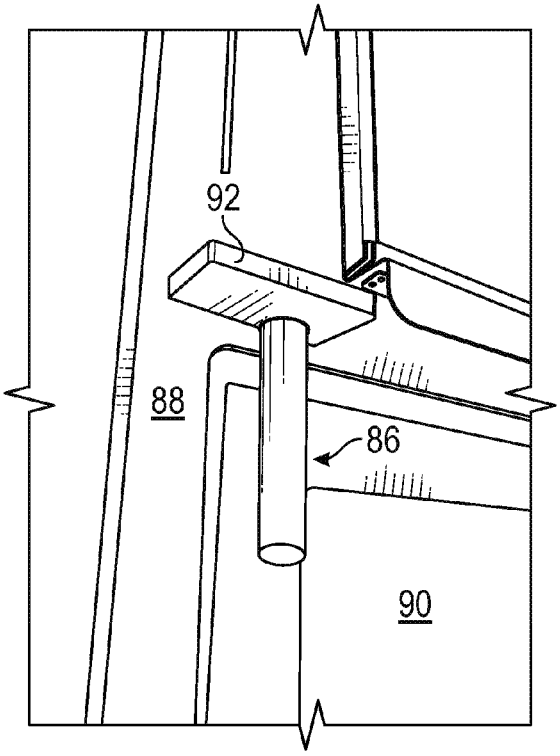
FIG. 7 is a left side view of an implementation of a first hinge front mounted on a display cabinet.
Figure 8:
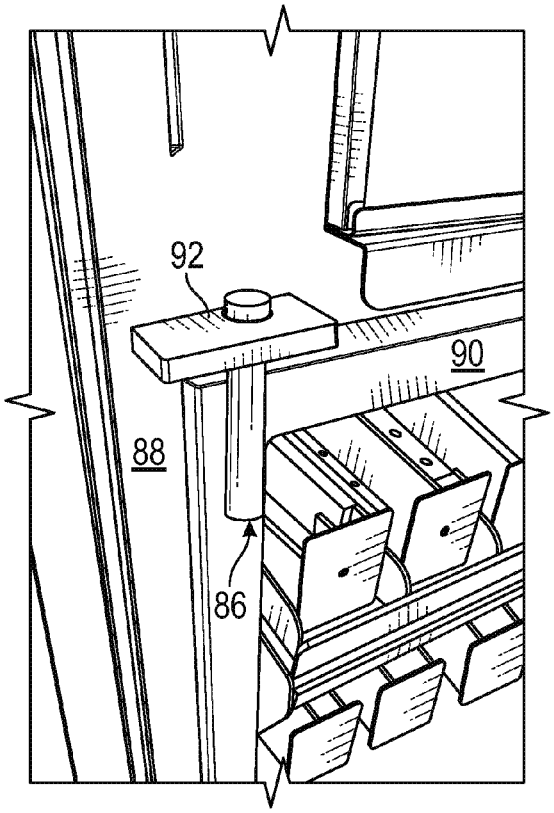
FIG. 8 is a right side view of an implementation of a first hinge front mounted on a display cabinet.

Referring now to FIGS. 7 and 8, a close up view of the first one 86 of the hinges is illustrated. The first hinge 86 is front mounted to the first module 88 and front mounted to the first door 90. Front mounting the hinges allows the door to move out of the way of the first storage area when the door is in an open position. The first hinge 86 is rotatably coupled into a receiver 92 in the first shelving area. The hinge is mounted to the door 90 and the receiver 92 is mounted to the first module 88. The hinge is able to rotate within the hole of the receiver as can be seen more clearly in FIG. 8. The first hinge 86 and the receiver 92 may be mounted to the first door 90 and first module 88, respectively, through welding, soldering, gluing or another suitable mounting method.

Figure 9:
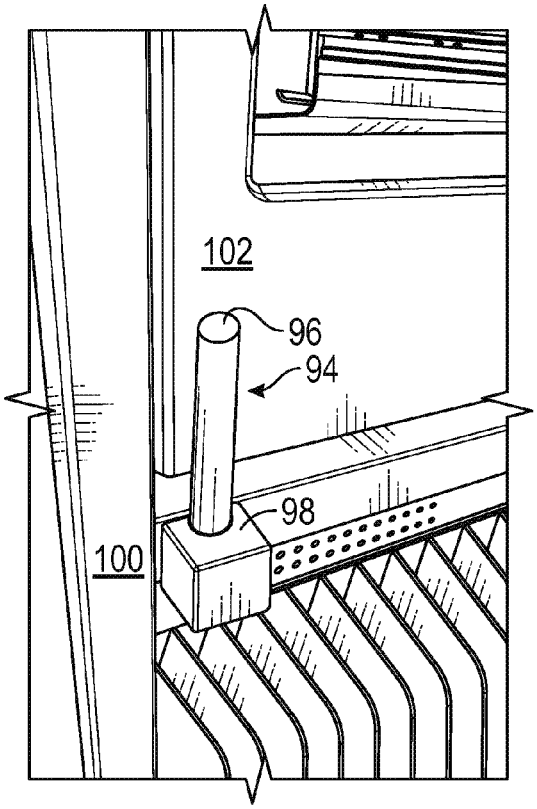
FIG. 9 is a left side view of an implementation of a second hinge front mounted on a display cabinet.
Figure 10:
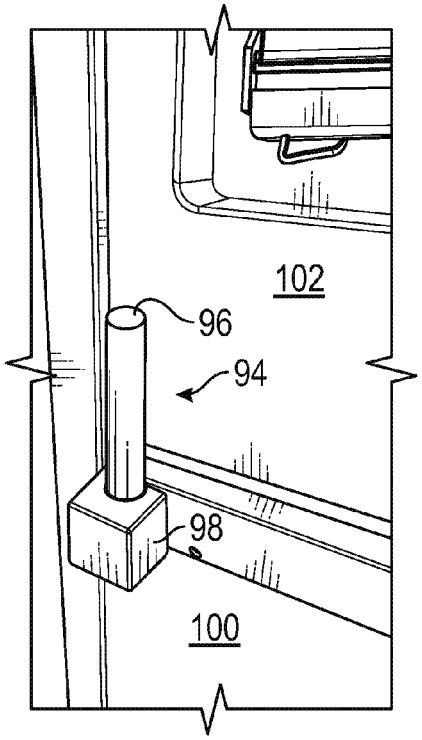
FIG. 10 is a right side view of an implementation of a second hinge front mounted on a display cabinet.

Referring now to FIGS. 9 and 10, a close up view of a second one 94 of the hinges is illustrated. The second one 94 of the hinges includes a pin 96 that couples within a receiver 98 coupled with the base 100. The pin 96 is front mounted to the door 102 of a display cabinet while the receiver 98 is front mounted to the base 100 of the first module. As previously described with the first hinge, the second hinge is front mounted to allow full movement of the door while accessing the first shelving area of the first module. The first one of the hinges and the second one of the hinges were custom manufactured by Aerospace Southwest of Phoenix, Ariz.

Figure 11:
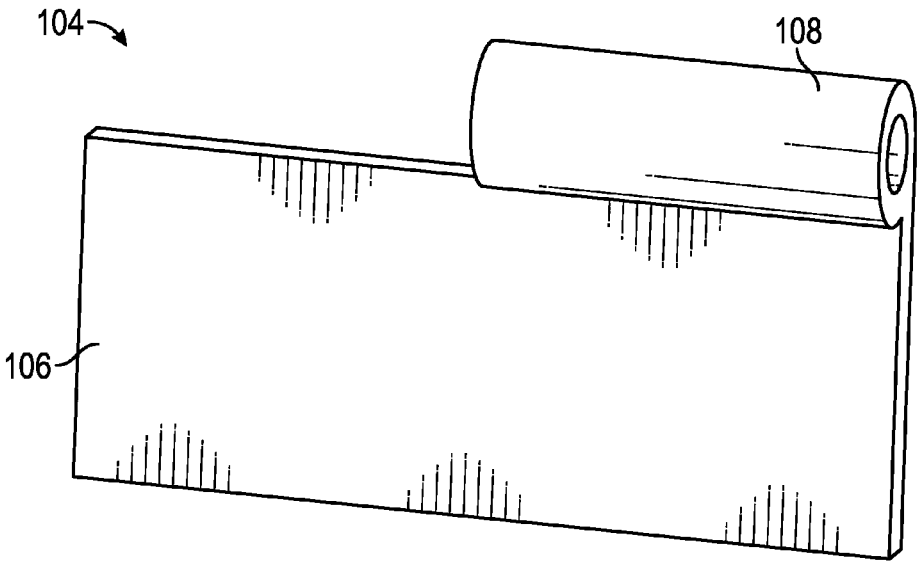
FIG. 11 is a side view of half of an implementation of a hinge showing a leaf and knuckle of a hinge.
Figure 12:
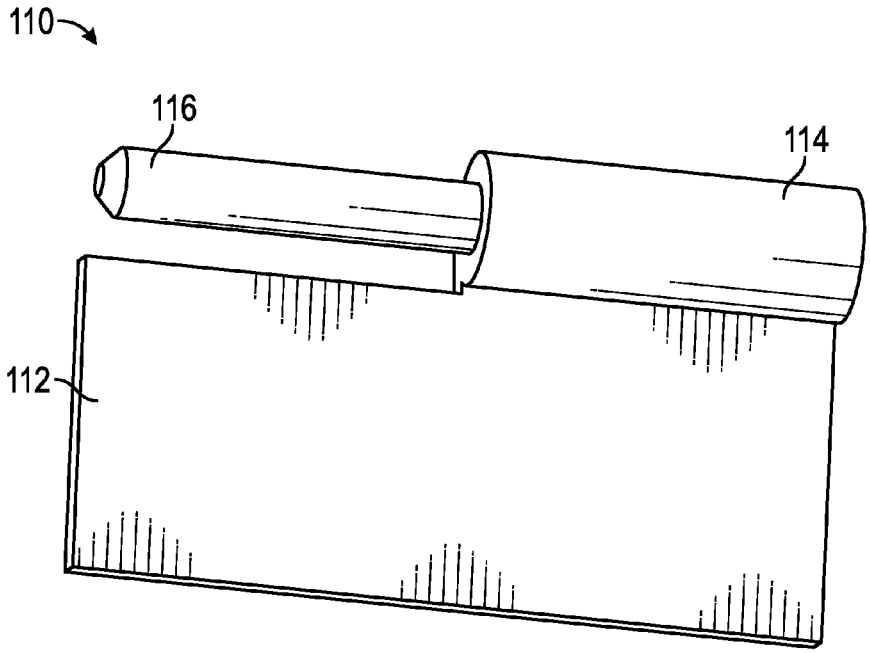
FIG. 12 is a side view of another half of an implementation of a hinge showing a leaf and knuckle having a pin.

Referring now to FIGS. 11 and 12, an implementation of a standard hinge is illustrated. A standard hinge may also be used to front mount the first door to the first module as previously described and shown in FIG. 1. Referring to FIG. 11, a first portion 104 of a standard hinge is illustrated. The first portion of the hinge includes a leaf 106 and a knuckle 108. Referring to FIG. 12 a second portion 110 of a standard hinge is illustrated. The second portion includes a leaf 112, a knuckle 114 and a pin 116 extending from the knuckle 114. The pin 116 of the second hinge portion 110 inserts into the knuckle 108 of the first hinge portion 104 and rotates as necessary when the hinge coupled to a door is opened and closed. A standard hinge may also be used to rotatably couple a second door to the top bar of the first module over the second shelving area. In various implementations, a standard hinge may be mounted to a display cabinet by one of soldering, welding, gluing, nailing, screwing or any other suitable mounting method known in the art.

Figure 13:
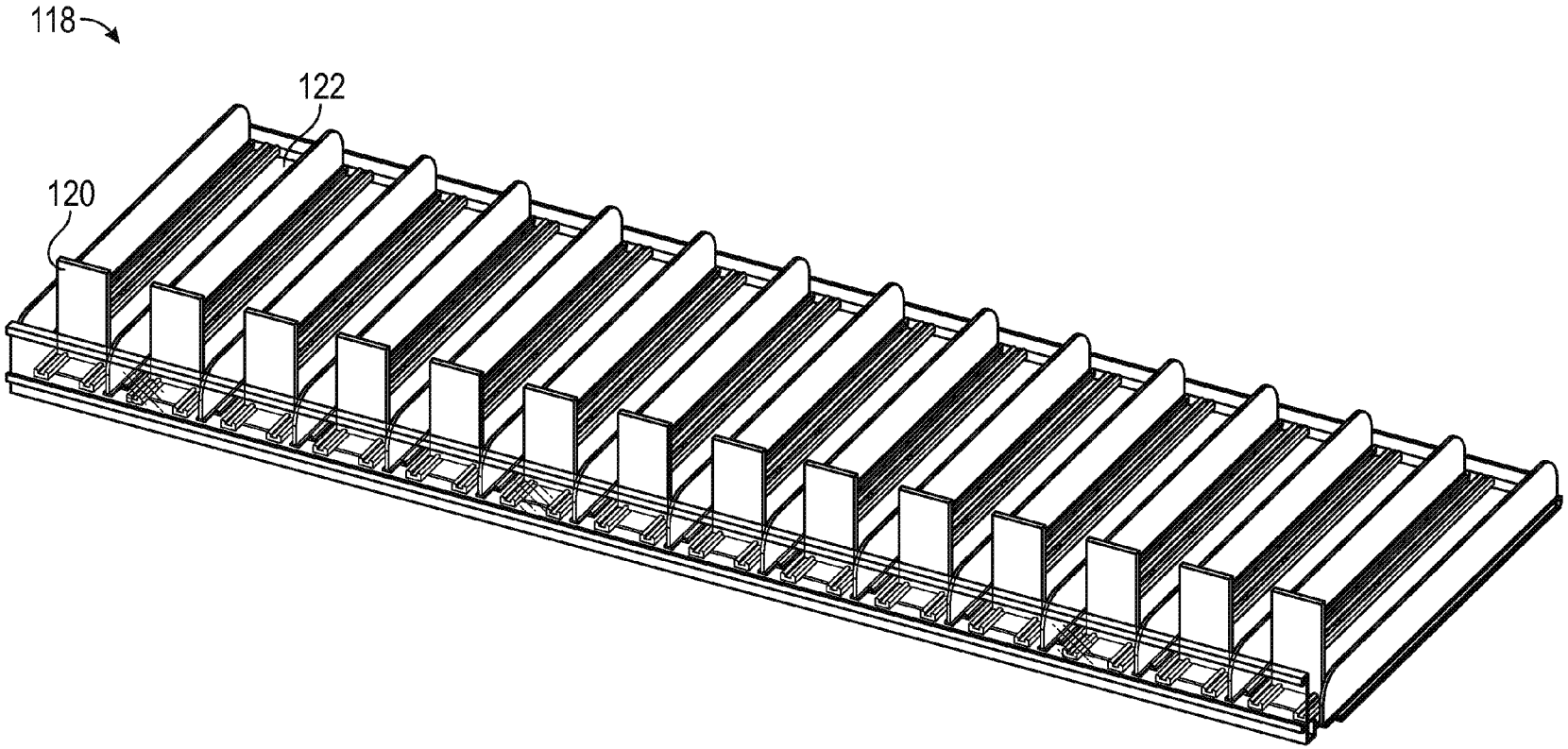
FIG. 13 is a perspective view of an implementation of a slide panel of a display portion of a display cabinet.

Referring now to FIG. 13, an implementation of a slide panel 118 is illustrated. A first display portion and a second display portion in a display cabinet may include a plurality of slide panels 118. The slide panels may be configured to hold and display a product where a product is placed in front of a tab 120 in each row 122 of the slide panel. As more product is loaded in front of the tab 120, the tab 120 moves farther back to make room. When product is removed, the tab 120 pushes the remaining product towards the front of the display so the front of the product is always visible and accessible to be removed. In this particular implementation, there are fourteen rows 122 available in which to display product. In other implementations, there may be more or less rows 122 depending on the need and side of the display. There also may be less rows if the rows have a larger width where the larger width is necessary to hold a larger product. The rows may be spring loaded so that the tab pushes as far forward as possible keeping products in an easy to access position on the slide panel. In other implementations, the rows may not be spring loaded and the tabs may be moved manually to keep the product at the front of the slide panel/display. By non-limiting example, the product may include packs of cigarettes, packs of gum, candy bars, and similarly sized products. A wide variety of slide panel types, sizes, and structures may be employed in various system implementations disclosed herein.

Figure 14:
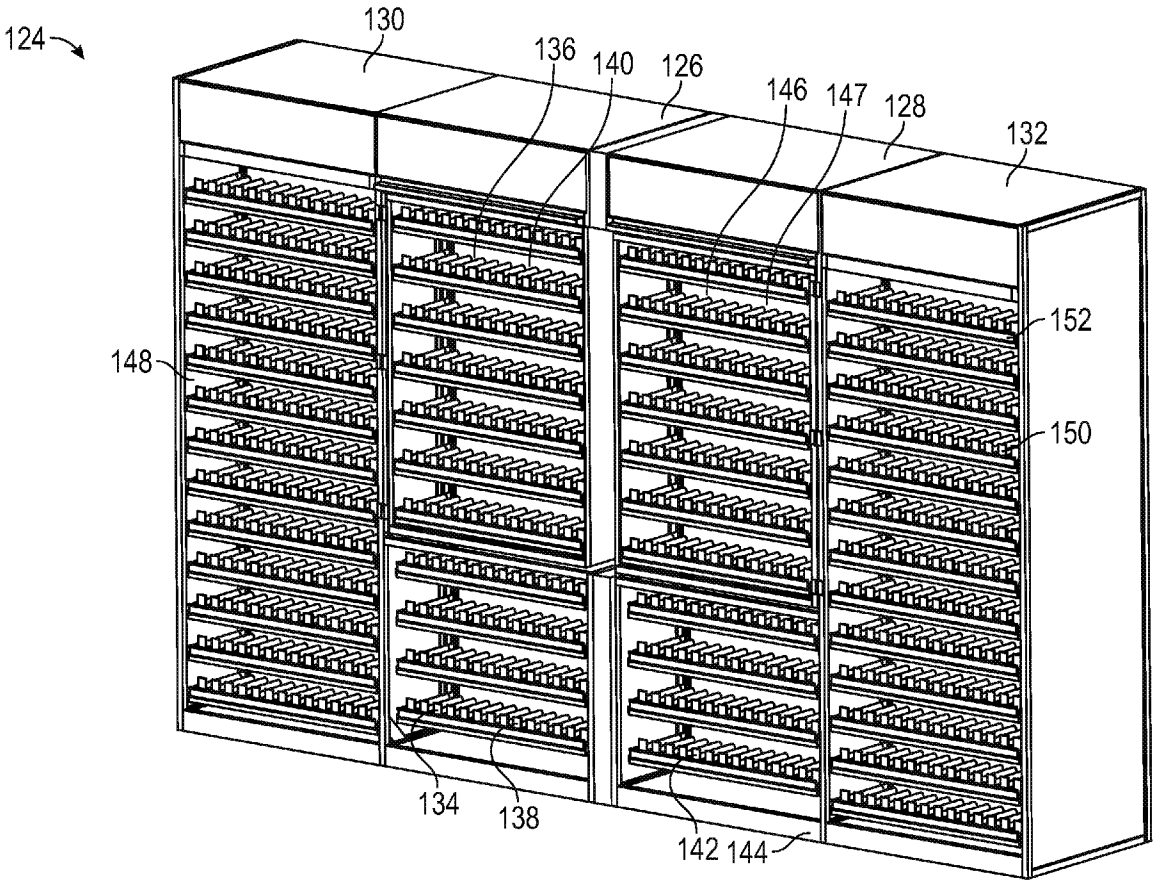
FIG. 14 is a front right perspective view of an implementation of a display cabinet.

Referring to FIG. 14, an implementation of a display cabinet 124 is illustrated. In this implementation of a display cabinet, there are four modules, a first module 126, a second module 128 and two additional cabinets 130 and 132. A first 130 of the two additional cabinets is on a side of the first module 126 and a second 132 of the additional cabinets is on a side of the second module 128. The first module 126 includes a first display portion 134 and a second display portion 136. The first display portion 134 is in a base 138 of the first module 126 coupled to one or more brackets within the base 138. The second display portion 136 is coupled within a first door 140 of the first module. As previously described in other implementations., the first door 140 is rotatably coupled to the first module through two or more hinges. The second module 128 also has a first display portion 142 coupled to one or more brackets within the base 144 of the second module 128 and a second display portion 146 within the first door 147 of the second module 128. The two additional cabinets 130 and 132 each include a third display portion 148 and 150. The first display portions 134 and 142, the second display portions 136 and 146, and the third display portions 148 and 150 each include a plurality of slide panels 152. In various implementations, the slide panels 152 may be used to hold and display a product.

Figure 15:
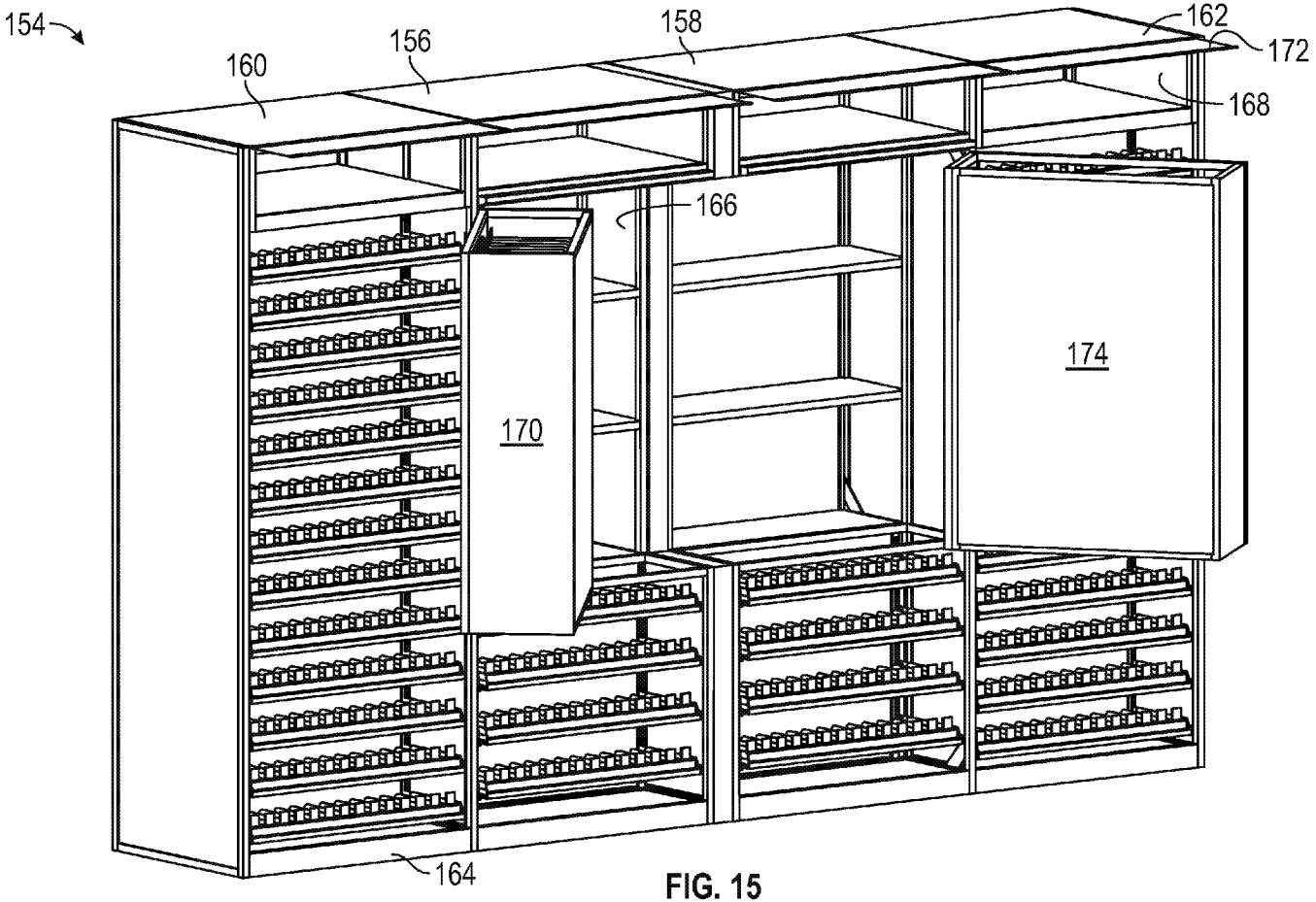
FIG. 15 is a front left perspective view of an implementation display cabinet with a left-handed door and a right-handed door in an open position.

Referring now to FIG. 15 an implementation of a display cabinet 154 in an open position is illustrated. As previously described, the display cabinet has a first module 156, a second module 158 and two additional cabinets 160 and 162 on a side of the first module 156 and on a side of the second module 158, respectively. The first module 156 includes a base 164, a first shelving area 166 and a second shelving area above the first shelving area. A first door 170 is rotatably positioned adjacent to the first shelving area 166. The first door 170 is configured to conceal the first shelving area 166 when the first door 170 is in a closed position as illustrated in FIG. 14. In this implementation, the first module 156 is a left-handed module as previously described. The second module 158 is a right-handed module as previously described. Each of the first module 156, the second module 158 and the two additional modules/cabinets 160 and 162 include a second shelving area 168 above the first shelving areas/display portions of the modules. This second shelving 168 area may be covered through the use of a second door 172 that is rotatably coupled to a top bar of the first module over the second shelving area 168. The second door 172 may include advertising information for, by non-limiting example, the product displayed in the display areas on the display cabinet, an advertisement for the location of the display cabinet, general business advertisement or other suitable uses known in the art.

In places where the description above refers to particular implementations of display and storage cabinets and implementing components, sub-components, methods and sub-methods, it should be readily apparent that a number of modifications may be made without departing from the spirit thereof and that these implementations, implementing components, sub-components, methods and sub-methods may be applied to other display and storage cabinets.

What is claimed is:

1. A display cabinet comprising:

a first module comprising a base, a first shelving area and a second shelving area;

a first door rotatably positioned adjacent to the first shelving area;

two or more hinges front mounted to the first module and front mounted to a side of the first door, wherein a first one of the hinges is rotatably coupled into a receiver in the first shelving area and wherein a second one of the hinges comprises a pin that couples within a receiver coupled with the base;

a first display portion coupled to one or more brackets within the base of the first module; and a second display portion coupled to one or more brackets positioned on either side of a back panel of the first door.

2. The display cabinet of claim 1, wherein the first door is reinforced to support a weight of the second display portion.

3. The display cabinet of claim 1, wherein the first door is a left-handed door and the two or more hinges are front mounted on the left side of the left-handed door.

4. The display cabinet of claim 1, wherein the first door is a right-handed door and the two or more hinges are front mounted on the right side of the right-handed door.

5. The display cabinet of claim 1, further comprising a second door rotatably coupled to a top bar of the first module over the second shelving area.

6. The display cabinet of claim 1, wherein the first and the second display portions each comprise a plurality of slide panels configured to hold and display a product.

7. The display cabinet of claim 1, further comprising:

a second module comprising:

a base;

a first shelving area;

a second shelving area;

a first door rotatably positioned adjacent to the first shelving area;

two or more hinges front mounted to the first module and front mounted to a side of the first door, wherein a first one of the hinges is rotatably coupled into a receiver in the first shelving area and wherein a second one of the hinges comprises a pin that couples within a receiver coupled with the base;

a first display portion coupled to one or more brackets within the base of the second module; and a second display portion coupled to one or more brackets positioned on either side of a back panel of the first door;

wherein the first module is left-handed and the second module is right-handed.

8. The display cabinet of claim 7, further comprising two or more additional cabinets each comprising third display portions, each one of the two or more additional cabinets positioned on one of a side of the first module and a side of the second module.

9. A display cabinet comprising:

a first module comprising a base, a first display portion within the base, a first shelving area above the base, and a second shelving area above the first shelving area;

a first door coupled to a first side of the first module configured to conceal the first shelving area;

two or more hinges front mounted to the first module and front mounted to a side of the first door; wherein a first one of the hinges is rotatably coupled into a receiver in the first module and wherein a second one of the hinges comprises a pin that couples within a receiver coupled with the base; and a second display portion coupled to one or more brackets within the first door;

wherein the first door is rotatable on the two or more hinges across a majority of a width of the first module.

10. The display cabinet of claim 9, wherein the first door is reinforced to support a weight of the second display portion.

11. The display cabinet of claim 9, wherein the first door is a left-handed door and the two or more hinges are front mounted on the left side of the left-handed door.

12. The display cabinet of claim 9, wherein the first door is a right-handed door and the two or more hinges are front mounted on the right side of the right-handed door.

13. The display cabinet of claim 9, further comprising a second door rotatably coupled to a top bar of the first module over the second shelving area.

14. The display cabinet of claim 9, wherein first and second display portions each comprise a plurality of slide panels configured to hold and display a product.

15. The display cabinet of claim 9, further comprising a second module comprising:

a base, a first shelving area and a second shelving area;

a first door rotatably positioned adjacent to the first shelving area;

two or more hinges front mounted to the first module and front mounted to a side of the first door, wherein a first one of the hinges is rotatably coupled into a receiver in the first shelving area and wherein a second one of the hinges comprises a pin that couples within a receiver coupled with the base;

a first display portion coupled to one or more brackets within the base of the second module; and a second display portion coupled to one or more brackets positioned on either side of a back panel of the first door;

wherein the first module is left-handed and the second module is right-handed.

16. The display cabinet of claim 15, furthering comprising two or more additional cabinets each comprising a third display portion, each one of the two or more additional cabinets positioned on one of a side of the first module and a side of the second module.

17. A display cabinet system comprising:

a left module and a right module, each of the left module and right module comprising:

a base, a first display portion within the base, a first shelving area above the base, and a second shelving area above the first shelving area;

the left-handed module further comprising:

a left-handed door rotatably coupled to a left side of the left module in a position covering the first shelving area; and two or more hinges front mounted to the left module and front mounted to a left side of the left-handed door; wherein a first one of the hinges is rotatably coupled into a receiver in the left module and wherein a second one of the hinges comprises a pin that couples within a receiver coupled with the base of the left module;

the right-handed module further comprising:

a right-handed door rotatably coupled to a right side of the right module in a position covering a width of the first shelving area of the right module; and two or more hinges, wherein a first one of the hinges is rotatably coupled into a receiver in the right module and wherein a second one of the hinges comprises a pin that couples within a receiver coupled with the base of the right module;

wherein the left-handed door and the right-handed door can each pivot on the two or more hinges and move in and out across a width of the left module and the right module, respectively.

18. The display cabinet of claim 17, wherein the left-handed door and the right-handed door are each reinforced to support a weight of the second display portion.

19. The display cabinet of claim 17, further comprising a second door rotatably coupled to a top bar of the each of the left module and the right module over the second shelving area.

20. The display cabinet of claim 17, wherein the first and second display portions of both the left-handed module and of the right-handed module each comprise a plurality of slide panels configured to hold and display a product.

* * * * *